United States Patent [19]

Theurer

[11] 4,031,625

[45] June 28, 1977

[54] REFERENCE SYSTEM FOR A TRACK WORKING MACHINE

[75] Inventor: Josef Theurer, Vienna, Austria

[73] Assignee: Franz Plasser Bahnbaumaschinen-Industrie-Gesellschaft m.b.H., Vienna, Austria

[22] Filed: Dec. 22, 1975

[21] Appl. No.: 643,511

[30] Foreign Application Priority Data

Feb. 7, 1975 Austria ..... 957/75

[52] U.S. Cl. ..... 33/1 Q; 104/8

[51] Int. Cl.² ..... E01B 33/00

[58] Field of Search ..... 33/1 Q, 1 LE, 144, 146, 33/174 R, 174 L, 287; 104/7 R, 8

[56] References Cited

UNITED STATES PATENTS

| | | | |
|---|---|---|---|
| 2,962,979 | 12/1960 | McCormick | 33/287 |
| 3,165,073 | 1/1965 | Blix et al. | 33/1 Q |
| 3,463,095 | 8/1969 | Plasser et al. | 104/8 |
| 3,547,037 | 12/1970 | Plasser et al. | 104/7 R |
| 3,547,039 | 12/1970 | Plasser et al. | 104/8 |

FOREIGN PATENTS OR APPLICATIONS

| | | | |
|---|---|---|---|
| 1,244,994 | 9/1971 | United Kingdom | 104/8 |
| 1,005,190 | 9/1965 | United Kingdom | 33/1 Q |
| 1,204,134 | 9/1970 | United Kingdom | 33/287 |

*Primary Examiner*—Richard E. Aegerter
*Assistant Examiner*—Richard R. Stearns
*Attorney, Agent, or Firm*—Kurt Kelman

[57] ABSTRACT

A reference system for a track leveling and/or lining tamper comprises a reference wire or cord whose end and measuring points are held on bogies connected to the machine and laterally pressed against a selected track rail. A clamping mechanism is associated with the reference wire or cord and is fixedly connected to one or more of the bogies for selectively reducing and increasing the effective measuring length of the reference wire or cord between the end points thereof.

7 Claims, 6 Drawing Figures

REFERENCE SYSTEM FOR A TRACK WORKING MACHINE

The present invention relates to a reference system for a track working machine mounted for mobility on the rails of a track, such as a track leveling and/or lining tamper, which comprises an elongated flexible reference line, such as a wire or cord, having two end points and at least one intermediate measuring point. In known systems of this type, bogies are connected to the machine at each of the reference line points and each point is held on a respective ones of the bogies. Drives hold each of the bogies under lateral pressure against a selected one of the track rails to establish accurate reference points, such drives consisting, for instance, of preferably remote-controlled hydraulic motors.

The selection and specific arrangement of the reference system for track working machines depends on many variables, including, for instance, whether the machine is used for leveling or lining, whether the measuring system used requires one or more reference lines, whether work proceeds in a straight track section or a curve, and the like.

One known reference system for a track working machine comprises three successive and contiguous reference line portions constituted by a single, common wire. One-chord and two-chord reference systems are also known in track correction work, wherein the reference system is so arranged as to make work in opposite operating directions possible. All of these known reference systems have the disadvantage that adaptation of the system to work in straight and curved track sections often requires extensive and relatively expensive modifications, or that such adaptation is not possible at all and, without adaptation, the system leads to considerable measuring errors under changed operating conditions.

It is the primary object of this invention to provide a reference system of the indicated type which may be readily adapted to serve effectively under all operating conditions.

This and other objects are accomplished in accordance with the invention by associating a clamping mechanism with the reference line. The mechanism is fixedly connected to a respective one of the bogies for selectively reducing and increasing the effective measuring length of the reference line between the end points thereof for selected use as a reference for leveling and lining of the track.

This improvement makes it possible to shorten the reference line during operation in a curve and to lengthen it in tangent track in a very simple and rapid manner while increasing the accuracy of the system. The most favorable geometric proportions of the reference chord may thus be readily produced to reduce correction errors to a minimum, and additional measuring bogies may be eliminated, thus further reducing sources of error.

The above and other objects, advantages and features of the present invention will become more apparent from the following detailed description of a now preferred embodiment thereof, taken in conjunction with the accompanying drawing wherein FIG. 1 is a side elevational view of a mobile track leveling and lining tamper combined with a reference system according to this invention;

Figures 1, 2, 3, 4, 5, 6:
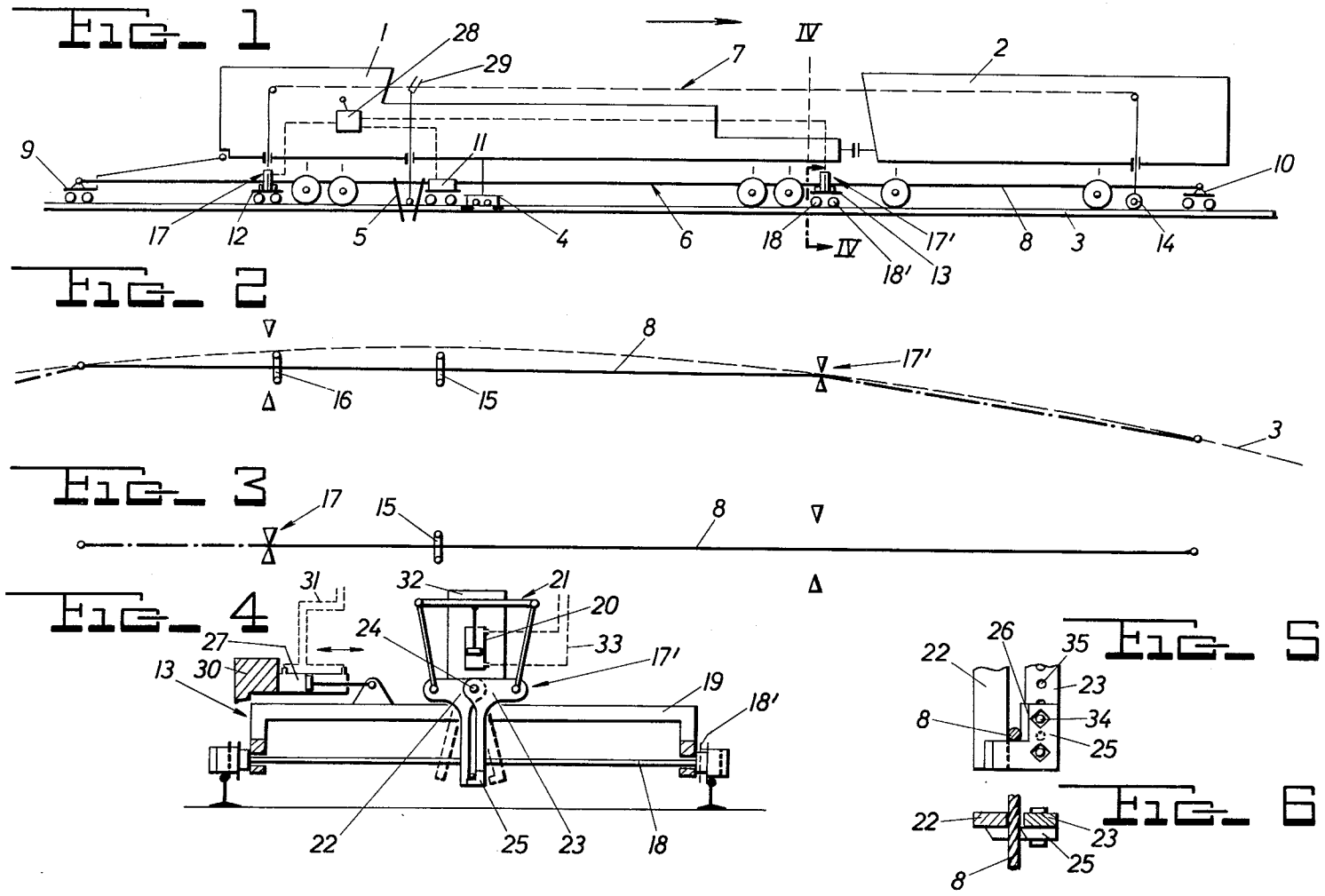
FIGS. 2 and 3 are purely schematic views showing the reference system under different operating conditions, with its clamping mechanism in and out of engagement with the reference line.
FIG. 4 is a schematic end view of a measuring bogie and a clamping mechanism fixedly connected thereto, partly in section along line IV—IV of FIG. 1.
FIG. 5 is an enlarged end view of the end region of the clamping mechanism and a reference line holding means thereat.
FIG. 6 is a top view of this end region, partly in section.

Referring now to the drawing, there is shown a generally conventional mobile track leveling and lining tamper 1 to which there is coupled a forward car 2 accommodating the work crew. The machine advances intermittently in the direction of the horizontal arrow on the rails of track 3 during track surfacing work to correct the position of the track and to fix the track in the corrected position by tamping. For the purpose of leveling and lining the track, machine 1 carries track leveling and lining unit 4 intermediate the front and rear undercarriage of the machine, and tamping unit 5 intermediate the leveling and lining unit 4 and the rear undercarriage. Reference system 6 controls the lining of the track and reference system 7 controls the leveling of the track.

Reference system 6 comprises reference wire or cord 8 having two end points anchored to rear bogie 9 located in a track section which has been lined and to front bogie 10 located in a track section which is to be lined forwardly of the front axle of car 2, reference line 8 being tensioned between the two bogies. Measuring bogies 11 and 12 are connected to machine 1 at respective intermediate measuring points whereat the position of track 3 in relation to reference line 8 is determined, bogie 12 being arranged behind the rear undercarriage of machine 1 and bogie 11 being arranged in the region of the track leveling and lining unit 4. A further measuring bogie 13 is connected to the machine forwardly of the front undercarriage.

Bogies 9 to 13 have flanged wheels running on the track rails and they are connected to the machine for common advancement therewith along the track by linking them to the frame of machine 1 or car 2 by means of coupling rods. Also, as well known and not specifically illustrated, preferably remote-controlled hydraulic drives mount the bogies on the machine to enable them to be pressed laterally against a selected one of the track rails and also to lift them off the track into a non-operative position.

Reference system 7 also comprises a reference wire or cord having two end points anchored to measuring bogie 12 and front bogie 14. A potentiometer sensing element 29 is mounted on machine 1 in the region of tamping unit 5 to cooperate with the reference wire and determine the vertical position of the track. As shown in FIGS. 2 and 3, measuring bogies 11 and 12 also carry potentiometers or other suitable transducers determining the lining control.

All of the above-described structure and its operation are conventional and have, therefore, not been described in detail.

According to this invention, the effective length of reference wire 8 may be selectively reduced or increased by clamping mechanisms 17 and 17′ mounted, respectively, on measuring bogies 12 and 13.

Mounting a respective clamping mechanism on intermediate bogies located in the track section whose position has been corrected and in the track section whose position is to be corrected has the advantage that a measuring point may be selected near either of the end points, thus improving the error measurements according to prevailing measuring conditions. In this manner, a single chord may be most advantageous used in lining tangent and curved track and can be readily converted from one to the other without any loss in accuracy.

FIG. 4 illustrated a preferred embodiment of the clamping mechanism, clamping mechanism 17′ mounted on measuring bogie 13 being shown on an enlarged scale. The measuring bogie consists of axle 18 carrying at its respective ends flanged wheels 18′ whose flanges may be selectively pressed into engagement with a selected grade rail between the position shown in full lines and in broken lines, and carrier frame 19 mounted on the axle. To provide an accurate measuring point, the bogie is pressed against the selected rail without play. For this purpose, a drive consisting of hydraulic motor 27 is linked to the carrier frame for pressing the bogie against the selected rail (the right rail in the illustrated position). The cylinder of the hydraulic motor is supported on fixed frame part 30. The hydraulic fluid supply conduit 31 preferably leads to a common hydraulic fluid supply for the motors for all the bogies so that their operation may be remote-controlled from a central operating cabin of the machine.

Carrier web 32 is mounted on frame 19 substantially centrally between the bogie wheels and extends perpendicularly and transversely of the track. The cylinder of hydraulic motor 20 is affixed to the carrier web and extends perpendicularly to the track, the piston rod of the motor projecting upwardly and being linked to a cross link of actuating lever arrangement 21. The lever arrangement further includes push and pull rods having one of their ends linked to respective ends of the cross link and their opposite ends linked to respective ends of oppositely facing arms of bell crank levers 22, 23 which cooperate in scissor-fashion and extend in a plane perpendicular to the track and transverse thereto. The two bell crank levers are pivoted at their fulcrums 24 to carrier web 32 for pivoting in this plane, pivot 24 extending parallel to the track. Vertical reciprocation of the piston rod of motor 20 will move clamping levers 22, 23 between a clamping position shown in full lines and an open position shown in broken lines.

The hydraulic supply conduit 33 also preferably leads to the common hydraulic supply of the machine so that the clamping mechanism may be remote-controlled from the central operating cabin, too. This enables the necessary adjustments to be made while the work proceeds so that the reference system may be simply and rapidly converted from adaptation to tangent track to adaptation to curves while maintaining a high accuracy. Furhermore, this remote control increases the safety of the operators because they need not leave the cabin during operation.

The specific structure of the scissor-like clamping levers makes it possible to engage the reference wire over a relatively wide range transversely to the track, thus enabling the mechanism to function, for instance, in a transition arc where the reference wire has been laterally displaced from its zero position. This provides secure clamping in all positions and failure-free operation of the mechanism.

As best shown in FIGS. 5 and 6, means 25 is provided at one of the ends of the clamping lever 23 for holding reference line 8 at a predetermined vertical position in relation to the track. The wire holding means is constituted by L-shaped element 25, one arm of this angle iron being fastened by two screw bolts 34 in selected ones of a series of threaded holes 35 in the outer end of clamping lever 23. This one arm has a beveled edge 26 for gripping engagement with the reference wire when the latter is clamped between this arm of the angle iron and the other clamping lever 22. The other arm of the angle iron extends below beveled edge 26 transversely to the track and overlaps clamping lever 22 in the closed position of the clamping mechanism so as to hold reference wire 8 in a predetermined vertical position as shown in FIG. 5. As can be seen in FIG. 6, the beveled edge projects slightly beyond clamping lever 23 towards clamping lever 22 so as to grip the reference wire firmly between this beveled edge, into which it presses, and clamping lever 22. Furthermore, the vertical position of element 25 is adjustable simply by choosing the holes 35 into which the fastening bolts are inserted, thus selecting the vertical position of the reference wire. This arrangement enables any sagging portion of the reference wire at the measuring point to be held at the selected vertical position. It also enables the reference wire to be held securely at all times.

The operation of the machine will be described hereinafter in connection with reference system 6, in conjunction with the schematic showing of FIGS. 2 and 3.

To survey or correct the position of a track, reference systems using either one or several reference lines are provided either to survey the track in a first operating stage and then to correct the track position in a second operating stage, or to survey and correct the track position in a single operating stage. To enable a track curve to be lined in a single stage, two measuring points at bogies 11 and 12 are provided along reference line 8. The measuring bogie 12 is located in a track section whose position has been corrected so that the correct ordinate, i.e. the distance between the reference chord 8 and the track, may be determined by voltage transformer 16. At the control panel 28 in the central operating cabin of the machine, the signal from voltage transformer 16 is compared with that received from voltage transformer 15 at measuring bogie 11 which is located in a track section whose position has to be corrected, taking into consideration the geometric spacing between the respective measuring bogies and reference end point 9. This type of track survey and position measurement is conventional and requires no further description to those skilled in the art, as is the control of the track lining unit 4 in response to the control signals to move the track laterally into the correct position. The margin of error caused by the position of the measuring bogie 13 in the uncorrected track section is considerably reduced by the use of two measuring points 11 and 12.

The reference wire is fixed in its position relative to measuring bogie 13 by means of clamping mechanism 17′ which is fixedly connected to the bogie. In this manner, the effective measuring length of reference wire 8 for surveying the track position and controlling the same is limited to the portion of the wire between rear bogie 9 and measuring bogie 13. The reference wire extends to front bogie 10 but the portion of the wire between measuring bogie 13 and front bogie 10 is not used.

After the track arc shown in FIG. 2 has been lined and the entire reference line again extends in a tangent track section, as illustrated in FIG. 3, clamping mechanism 17′ is opened and wire 8 is clamped at 17. This effectively changes the ratio of the reference line length between front end point 10 and measuring bogie 11, with its lining signal emitter 15, and the reference line length between its end points, the rear end point having been effectively moved from bogie 9 to bogie 12 on which clamping mechanism 17 is mounted. This considerably increases the accuracy of the measurement with a single signal emitter 15.

Furthermore, the excess length of the reference line makes it possible to take into consideration and to correct long wave errors which are due, for instance, to the sinuous movement of the cars. Also, the clamping of the reference wire prevents the error signal emitter which is located in the corrected track section from adversely influencing the track correction in case a residual error remains in the corrected track section. Using the two-clamp arrangement 17, 17′ makes it possible readily to convert the four-point reference system for correcting track curves into a three-point reference system with a very long reference base. Using the reference system in the manner shown in FIG. 3 makes it possible to stretch the entire length of reference wire 8 between end bogies 9 and 10 but not to use the portion of the wire between end bogie 9 and measuring bogie 12.

Clamping mechanisms 17 and 17′ may be operated by remote control from control station 28 by manually throwing a switch or slide, for instance.

As the machine advances from a tangent track towards and into a track curve, it is advantageous to close clamping mechanism 17′ at measuring bogie 13 and to open clamping mechanism 17 at measuring bogie 12 for a certain distance before the easement begins. In this way, the machine can gradually work towards the curve with a shorter reference line and minor error differences, which may be produced during the conversion from the three-point to the four-point reference system, may be compensated before the machine actually enters the curve.

While the operation of the machine has been specifically illustrated and described in connection with a one-chord correction system, clamping mechanisms 17 and 17′ may be used advantageously without regard to the functioning of the specific correction system or the number of reference lines. Thus, the present invention is not limited to the preferred embodiment shown and described herein. For instance, hydraulic motors 20 and 27 could readily be replaced by equivalent or like drives, such as spindles, pinion-and-ratchet mechanisms or other mechanical drives. Similarly, the structure of the measuring bogies and/or the means for pressing them laterally against a selected rail may vary considerably. Obviously, the number and structure of the clamping mechanism also may be changed suitably to adapt to specific measuring and correction systems. The metes and bounds of the invention are accordingly defined by the appended claims.

I claim:

1. In a reference system for a track working machine mounted for mobility on the rails of a track, which reference system comprises an elongated flexible reference line having two end points and two intermediate measuring points, one of the intermediate measuring points being located in a corrected track section and another one of the intermediate measuring points being located in a track section to be corrected, bogies connected to the machine at each one of the reference line points, the two end point bogies each including means for securing the associated end point of the reference line thereto, and each of the two intermediate bogies including means to sense the position of the associated measuring point of the reference line with respect to the bogie, and drives holding each of the bogies under lateral pressure against a selected one of the track rails: the improvement of two clamping mechanisms associated with the reference line, each clamping mechanism being fixedly connected to a respective one of the intermediate bogies at the intermediate reference line points for selectively reducing and increasing the effective measuring length of the reference line between the end points thereof.

2. The reference system of claim 1, wherein the drives are remote-controlled hydraulic motors.

3. The reference system of claim 1, further comprising a pressure-fluid operated motor for actuating each clamping mechanism.

4. The reference system of claim 3, wherein the motor is remote-controllable.

5. The reference system of claim 3, wherein each clamping mechanism comprises two bell crank levers cooperating in scissor-fashion and extending in a plane perpendicular to the track and transverse thereto, and an actuating lever arrangement linked to the bell crank levers for selectively moving the levers together and apart, the motor being connected to the lever arrangement for actuating movement thereof.

6. The reference system of claim 5, further comprising means at one of the ends of the bell crank clamping levers for holding the reference line at a predetermined vertical position.

7. The reference system of claim 6, further comprising means for vertically adjustably fixing the reference line holding means on the one end of one of the bell crank levers.

* * * * *